US006585393B1

(12) United States Patent
Brandes et al.

(10) Patent No.: US 6,585,393 B1
(45) **Date of Patent: *Jul. 1, 2003**

(54) MODULAR ACCENT LIGHT FIXTURE

(75) Inventors: Brian Brandes, Brentwood, NY (US); Stephen E. Blackman, Florham Park, NJ (US)

(73) Assignee: Satco Products, Inc., Brentwood, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 174 days.

(21) Appl. No.: 09/169,448

(22) Filed: Oct. 9, 1998

(51) Int. Cl.[7] ..... F21V 21/00
(52) U.S. Cl. ..... 362/249; 362/240; 362/219; 362/250
(58) Field of Search ..... 362/219, 250, 362/249, 240, 244

(56) References Cited

U.S. PATENT DOCUMENTS 5,107,408 A * 4/1992 Vernondier ..... 362/249
5,743,632 A * 4/1998 Carl ..... 362/294
5,998,936 A * 12/1999 Nilssen ..... 315/109

* cited by examiner

*Primary Examiner*—Darren Schuberg
*Assistant Examiner*—Fayez Assaf
(74) *Attorney, Agent, or Firm*—Weiss & Weiss PC; Philip M. Weiss

(57) ABSTRACT

A light fixture uses printed circuit boards and is adapted to be modularly connected to other similar light fixtures to allow for any configuration of a light fixture to be provided. The light fixture may include a plurality of printed circuit boards which are removably provided in the light fixture and which simplify the manufacturing, substantially reduce the cost and size of the lighting system. More specifically, the light fixture includes a housing having first and second ends, electrical endcaps located at the first and second ends of the housing and at least one printed circuit board disposed inside of the housing and electrically connected to at least one of the electrical endcaps, the printed circuit board including a socket containing a lamp contained therein.

10 Claims, 7 Drawing Sheets

MODULAR ACCENT LIGHT FIXTURE

FIELD OF THE INVENTION

The present invention relates to a light fixture and more particularly to a light fixture which includes a printed circuit board and which has a structure allowing for light fixtures to be electrically connected and combined to form any size or configuration light fixture desired.

DESCRIPTION OF THE PRIOR ART

Light fixtures and in particular, under-cabinet light fixtures have been available and used for many years. Such light fixtures are manufactured to have a fixed size and configuration including a fixed number of lamps or bulbs. The conventional light fixtures, such as those used in applications such as under cabinets, under shelves, and display cases and used in exposed applications to illuminate artwork or podiums, contain lamps that are powered by either low voltage or line voltage current. Such light fixtures provide space advantages because of their small size and have a simple construction allowing for easy installation and maintenance. However, these conventional light fixtures are not arranged or adapted to allow for easy modular interconnection of multiple light fixtures to provide any size, configuration or number of light fixtures for any type of application.

The conventional light fixtures, including low voltage under-cabinet lighting fixture systems, have central conductors functioning as an electrical conduit and can have a construction of either detachable heads that contain sockets or fixed lamp sockets attached directly to the conduit. In these cases and in other variations, such as, low voltage system, a miniature high output, low voltage lamp is used. These lamps and their related systems typically allow the fixture to be small in size and easy to mount. However, by their nature, low voltage systems require the use of transformers for their electrical functioning. As a result, the number of lamps and the size and configurations of the light fixtures that can be feasibly installed is limited by size and placement of these transformers.

In addition, the required transformers increase the cost and difficulty of manufacturing the light fixtures. Also, if the transformers are not installed in the light fixture properly, malfunctioning such as dimming of the lamps or overloading of the fixture will occur.

The present invention overcomes the problems of using transformers in light fixtures of the prior art by using individual printed circuit boards in each module. Each PC board can be arranged so that low voltage lamps of proper electrical value are in a particular series configuration such that the voltage of a standard line voltage current would be sufficient to power the series of lamps without the need of an electronic transformer. The printed circuit boards in the light fixtures serve as the distribution wire ways that also provide the electrical power to the connectors between modules. The PC board allows the fixture to be compact in size and also provides for easy manufacturing and mounting into the housing.

SUMMARY OF THE INVENTION

The present invention overcomes the problems described above by providing a light fixture which does not require transformers and is adapted to be modularly connected to other similar light fixtures to allow for any configuration of a light fixture to be provided.

The present invention overcomes the problems of using transformers in light fixtures of the prior art by using individual printed circuit boards in each module of the light fixture and also provides for easy manufacturing and mounting into the housing.

The present invention provides a light fixture including a plurality of printed circuit boards which are removably provided in the light fixture and which substantially reduce the cost and size of the lighting system.

In a preferred embodiment of the present invention, a light fixture includes a housing having first and second ends, electrical endcaps located at the first and second ends of the housing and at least one printed circuit board disposed inside of the housing and electrically connected to at least one of the electrical endcaps, the printed circuit board including a socket containing a lamp contained therein.

The printed circuit board fits securely into the housing, preferably via a receiving or grooved channel however, a snap fit configuration or other means may also be used. The printed circuit board preferably extends along a length of the housing. The electrical endcaps are preferably attached to the housing so as to hold the printed circuit board in place. The above-described construction is arranged to define a modular fixture unit that can be used as a single unit or connected to any number of the same modular type units to define any size, shape, configuration light fixture having any number of sockets or lamps.

More specifically, the light fixture according to the preferred embodiments of the present invention has a construction which allows the light fixture to be electrically connected to multiple similar light fixture units to form a desired length, to avoid the disadvantages of the conventional single piece unit having an unchangeable size and configuration. In the present invention, the user can change the size of the light fixture by adding or subtracting modules. The use of the printed circuit board allows an electrified socket to be attached, but also allows for easy electrical distribution between other light fixture modules.

Preferably the lamp and printed circuit board construction is rotatable and movable to any desired position by being rotatable relative to the mounting surface. The fixture according to the preferred embodiments of the present invention is very versatile in that the printed circuit boards can be easily replaced by the manufacturer to change the socket layout and to provide a desired electrical circuitry for a particular application. In addition, the socket arrangement on the PC board can be connected in series or in parallel, and allows the use of a low voltage or line voltage circuit to the sockets. Further the socket arrangement allows the manufacturer the option to power the light fixture with a transformer if desired.

It is a further object of the present invention to provide a light fixture system of unique components that can allow a variety of fixture size options and mounting possibilities. The light fixture system can be mounted as a single unit or can be mounted with a series of light fixture units in multiple runs. Because of the use of printed circuit boards, any number of light fixture modules can be easily and quickly connected by the user to each other and mounted to form a light fixture system.

It is preferable that one or more of the light fixture modules are rotatable relative to their respective mounting surface so as to be able to direct light in any desired direction.

It is also preferred that the light fixture modules include a high temperature protective lens designed to evenly diffuse the outputted light and to allow for easy lamp replacement upon removal of the lens. The protective lens also prevents the consumer from accidentally coming into contact with the heated lamps when the light fixture unit is in operation.

These and other advantages, features and elements of the preferred embodiments of the present invention will become more apparent from the drawings and description appended hereto.

BRIEF DESCRIPTION OF DRAWING FIGURES

DETAILED DESCRIPTION OF PREFERRED EMBODIMENTS

Figure 1:
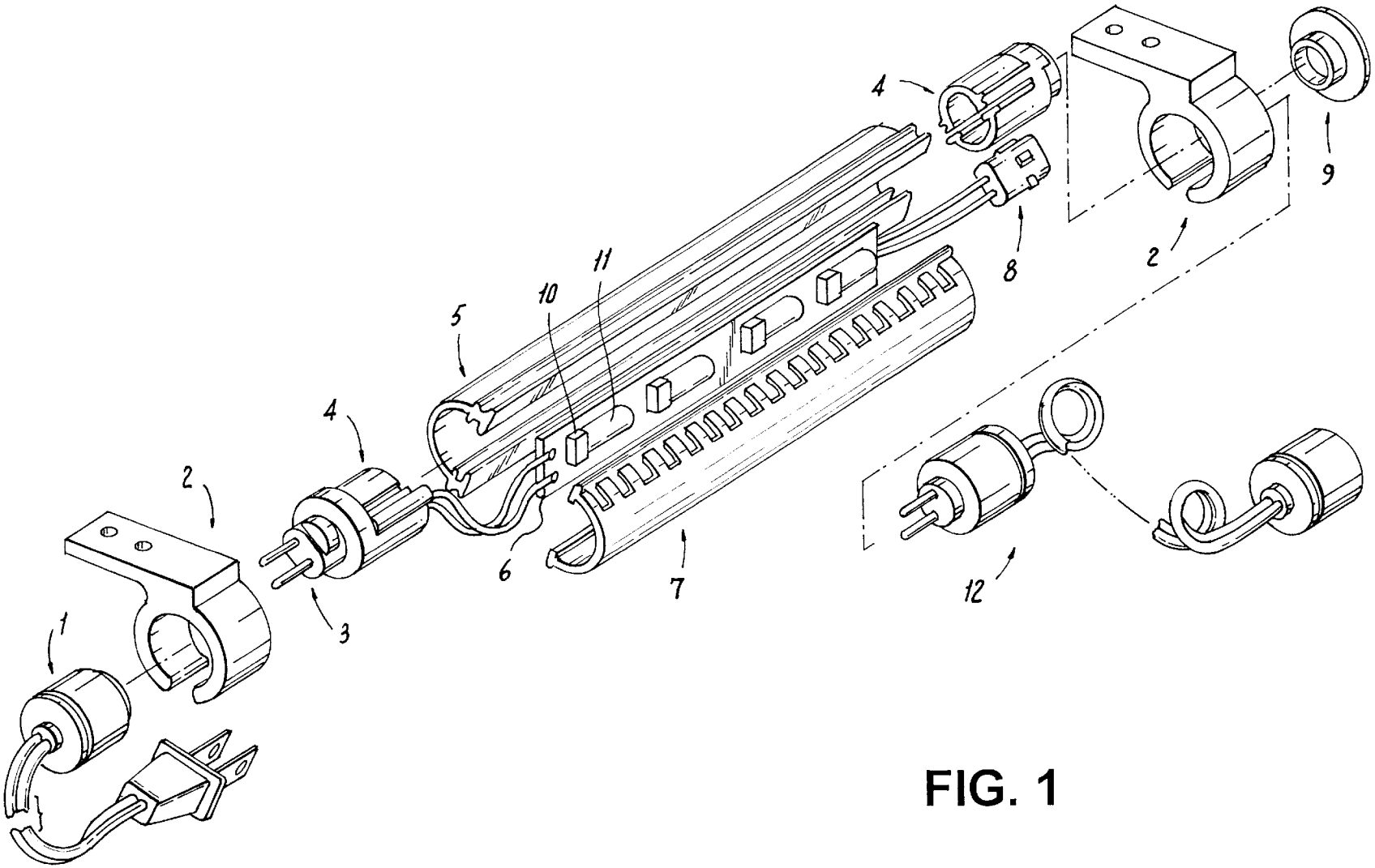
FIG. 1 is an exploded view of a preferred embodiment of the present invention.

FIG. 1 illustrates an exploded view of a preferred embodiment of the present invention. The preferred embodiment of the present invention shown in FIG. 1 is a modular light fixture 100 including a housing 5, a lens or cover 7 which is attached to the housing 5. The lens 7 is preferably internally ribbed and force fittingly attached to the housing 5 as shown in FIG. 1.

The modular light fixture 100 includes at least one printed circuit board 6 (PC board). The PC board 6 is coupled to an extruded end cap 4. The PC board 6 includes wire vias electrically coupling lamp sockets 10 to the electrical end cap 4. The PC board 6 may further include a rectifier or filter capacitor for regulating the voltage delivered to the sockets. PC board 6 may additionally include such conventional components such as diodes and electrolytic capacitors for further regulation of voltages. It will be clear to those of ordinary skill in the art that PC board 6 may be single-layered or dual-layered. One or more lamp sockets 10 are electrically and fixedly attached to PC board 6. A preferred method for attaching lamp sockets 10 to the PC board 6 is by solder and/or with a mechanical fastener. A lamp 11 is electrically and mechanically secured in each of the lamp sockets 10. The lamp 11 can be of any type, such as a Xenon lamp. Preferably, the lamp 11 is a replaceable, miniature lamp source, however any size lamp source can be used with the preferred embodiments of the present invention.

As is seen in FIG. 1, the PC board 6 is fixedly secured in the housing 5. The lens 7 is placed over the PC board 6 including the lamp sockets 10. The lens 7 preferably is made of a clear high temperature plastic. In a preferred embodiment the lens 7 snaps into the housing 5 although other means for attachment can be used. The lens 7 is designed to allow for easy lamp replacement when it is removed, and also to prevent the consumer from accidentally coming in contact with the hot lamps 11 when the unit is operating. The lens 7 is allows for maximum light transmission and diffusion. The lens 7 also preferably has openings that provide ventilation for the lamp 11 to let the heat generated thereby to escape and to avoid retaining heat therein.

A molded end cap 4 is provided at each of opposite ends of the housing 5. An internal male plug 3 is mechanically and electrically attached to the PC board 6 on one side of the fixture 100 and is disposed within a first one of the end caps 4. An internal female plug 8 is mechanically and electrically attached to the other side of the PC board 6 of the light fixture 100 and disposed within the other end cap 4. The molded end caps 4 fit into the housing 5 and keep the PC board 6 from sliding out of housing 5. The internal male plug 3 is then connected to a cordset 1 having a female modular plug. If desired, the female plug 8 can be connected to a male plug 3 of a second light fixture unit 100 according to the preferred embodiment shown in FIG. 1 if a second light fixture unit 100 is desired. The separate light fixture units 100 do not have to be directly attached to one another, such as two light fixture units 100 that would be attached at a corner of a wall such that a single construction can be mounted so as to be located on both sides of a corner of a structure. Such multiple light fixtures 100 can be connected electrically to each other via a coiled cordset 12. When the light fixture element 100 of FIG. 1 is not being attached to any further light fixture elements 100, a closed end cap 9 is placed at the end of the end cap 4 so there are no exposed electrical pieces.

The preferred embodiments of the present invention are preferably mounted on a support surface such as an underside of a wall, shelf, cabinet or similar structure by a support bracket 2 shown in FIG. 1. The support bracket 2 can be attached to the underside of a structure by screws, nails or other means known in the industry.

Figure 2A:
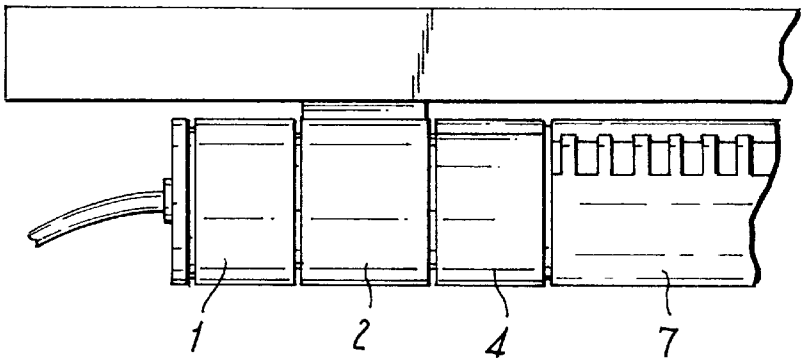
FIGS. 2A–2B are a front view of the invention
Figure 2B:
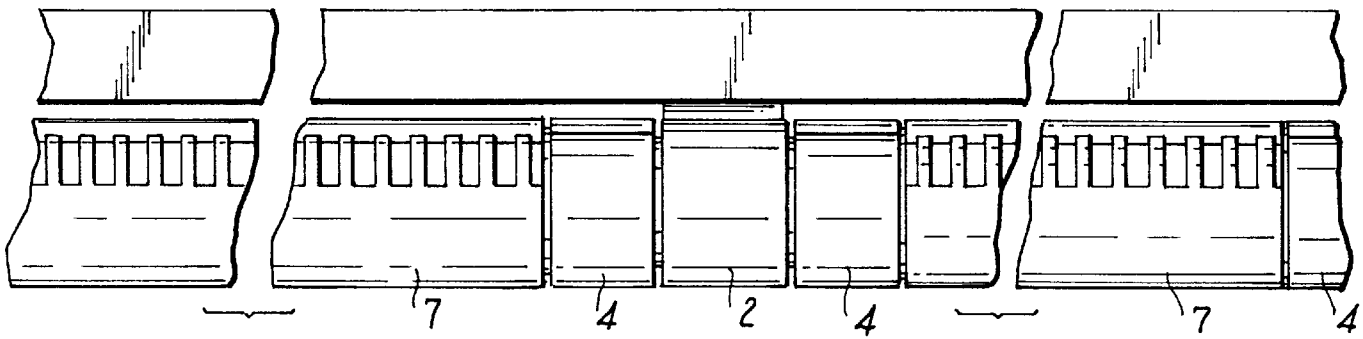
Figure 6:
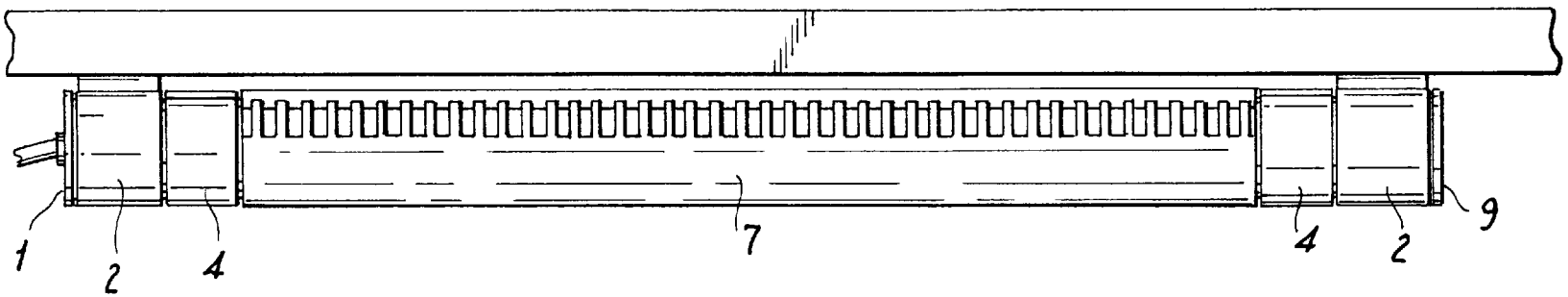
FIG. 6 is a front view of the invention

FIGS. 2A–2B shows a plurality of light fixture elements 100 interconnected to each other in accordance with the description of the multiple unit interconnection assembly described above. FIGS. 2A–2B illustrate the lens 7 which covers the internal features of the device. FIG. 6 illustrates a single light fixture element 100.

Figure 3:
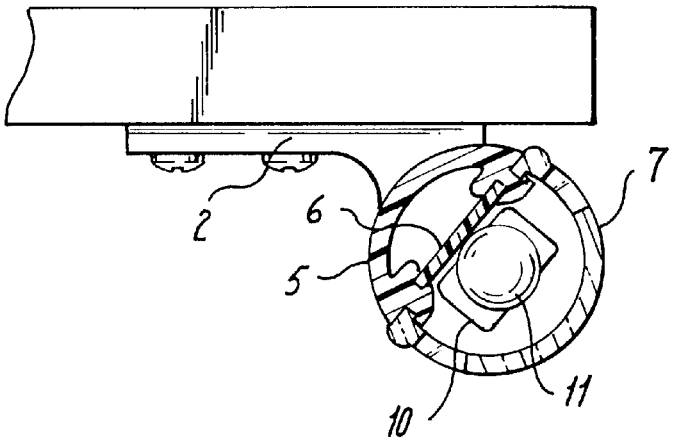
FIG. 3 is a cross section of the invention

FIG. 3 illustrates a cross section of the invention. Lamp 11 is attached to socket 10, the socket 10 being attached to PC board 6. The PC board 6 is fixedly attached to housing 5. Lens 7 as shown in this figure is snapped on to housing 5. The housing 5 can be rotated to direct the lamps 11 at an angle.

Figure 4A:
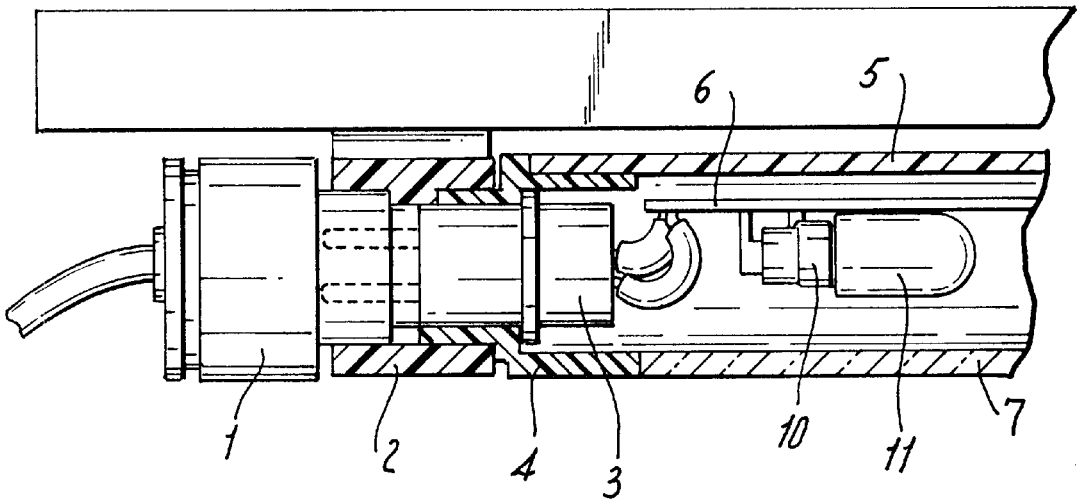
FIGS. 4A–4C are a longitudinal cross section of the invention
Figure 4B:
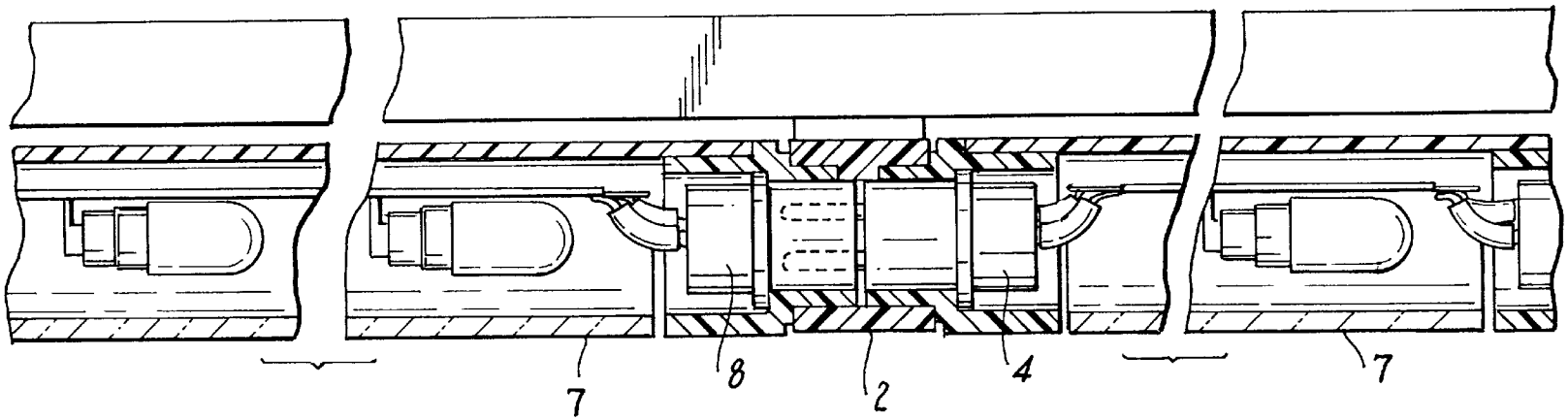
Figure 4C:
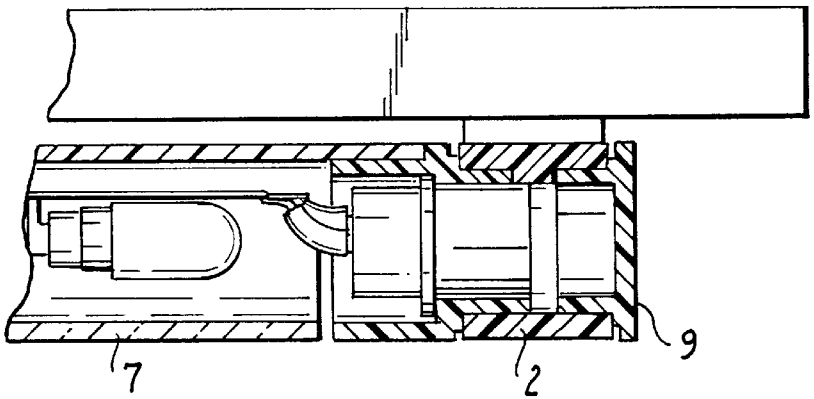

FIGS. 4A–4C illustrate the internal makeup of an embodiment of the present invention. FIG. 4 shows the connection between male plug 3 and female plug 1. The male plug 3 is held within an endcap 4. The male plug 3 is connected to the PC board 6. Attached to PC board 6 is a socket 10 having a lamp 11 within it. The PC board 6 is contained within a housing 5 which has attached to it a lens 7 which is shown in the figure as being ribbed. In a preferred embodiment of the present invention, the housing 5 is composed of an extruded plastic that makes up the main body and includes a groove inside thereof to receive and hold the printed circuit board 6 in place. The housing 5 further has two grooves on the inside surface that receive and hold a snap-in lens 7. The housing 5 also is attached at both ends to plastic molded endcaps 4 and closed end cap 9 that both lock the printed circuit board 6 in place and also retain each modular plug end 1, 3 and 8 in place within the housing 5. These endcaps also are designed to snugly fit into the mounting brackets 2 so as to allow the unit to easily rotate to many positionable angles and to firmly retain its position once the proper positioned angle is determined.

Figure 5:
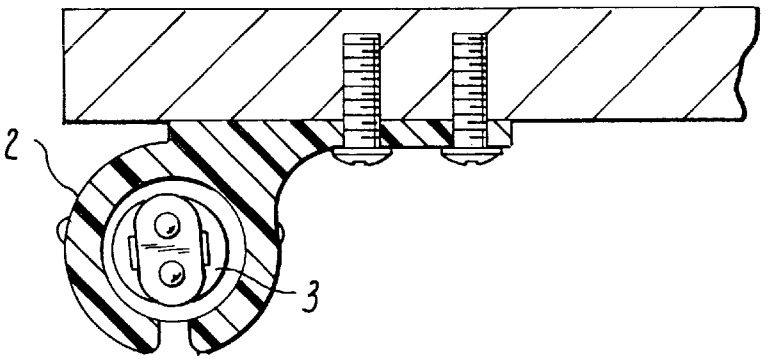
FIG. 5 is an end support bracket section

As seen in FIG. 5, the light fixture unit 100 of the preferred embodiments of the present invention is preferably held to the underside of a structure by a support bracket 2. FIG. 5 illustrates the support bracket 2 holding a light fixture unit 100 to the underside of a structure by a set of screws. Other known methods for hanging light fixtures can also be used to support units of the present invention.

Figure 7:
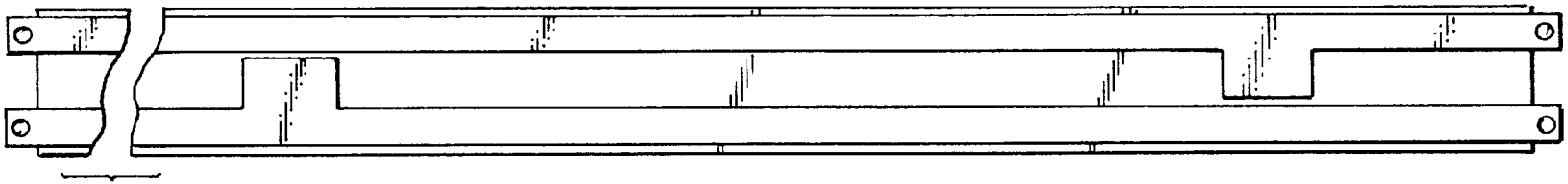
FIG. 7 illustrates the underside of a PC board for attachment in Parallel
Figure 8:
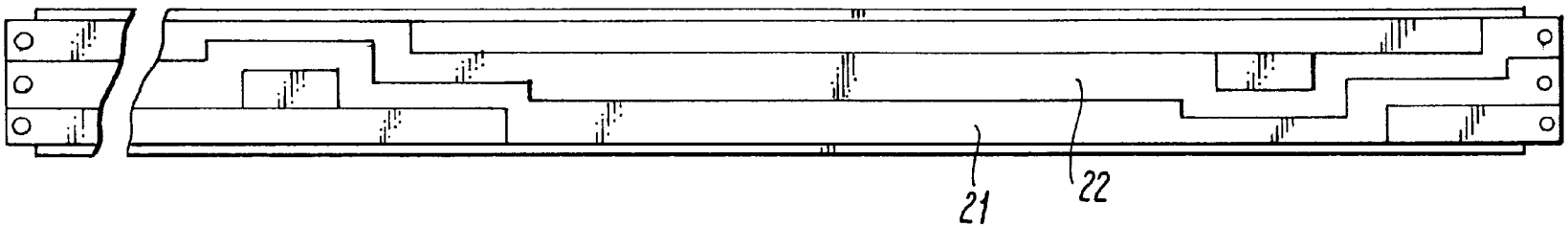
FIG. 8 illustrates the underside of a PC board for attachment in Series

FIGS. 7 and 8 illustrate the underside of PC board 6 which are respectively adapted and arranged for connection of lamp sockets 10 in parallel or in series. It will be apparent to those of ordinary skill in the art that a single transformer (not pictured) can be used if desired to regulate the electrical function of the sockets.

The method of electronic wiring is another unique aspect of the preferred embodiments of the present invention. A line voltage load is transmitted to the light fixture unit 100 from the modular connectors which are attached to the printed circuit board 6. The use of a printed circuit board 6 to distribute the electrical power to each individual socket 10 achieves the simplicity and effective electrical distribution of the light fixture unit 100 of the preferred embodiment of the present invention. The PC board 6 provides a simple and easy way to support and evenly distribute lamp sockets 10 in a uniform manner. The printed circuit board 6 is designed to connect all lamp sockets 10 in an electrical series or electrical parallel arrangement thereby eliminating the need for a transformer for each lamp socket to achieve a proper lamp rating. No transformers are required for each run of lamp sockets when the lamp sockets are properly arranged in series. The PC board 6 allows for the ability to continue an uninterrupted line of current to pass through to the modular connector at the other side of the unit by bypassing the series circuit attached to each lamp socket 10. The PC board 6 also allows for the application of reflective material behind each lamp 11 to further enhance its lumen output.

Figure 9:
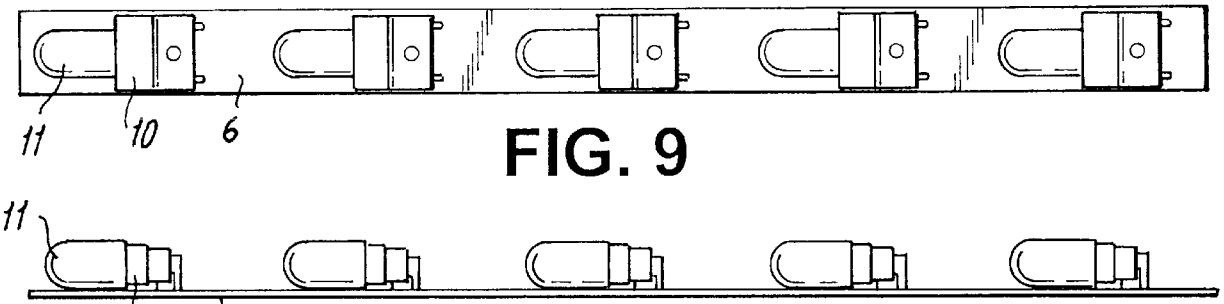
FIG. 9 illustrates a top view of a PC board with a socket assembly of the invention
Figure 10:
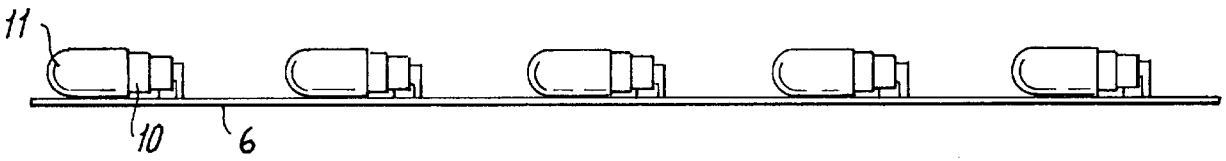
FIG. 10 illustrates a side view of a PC board with a socket assembly of the invention

FIG. 9 shows a top view of socket 10 soldered to PC board 6. FIG. 10 shows a side view of FIG. 9. Both FIGS. 9 and 10 show five sockets 10 attached to PC board 6. However, the preferred embodiments of the present invention can be designed so that each PC board 6 has a different number of sockets 10 attached.

Figure 11:
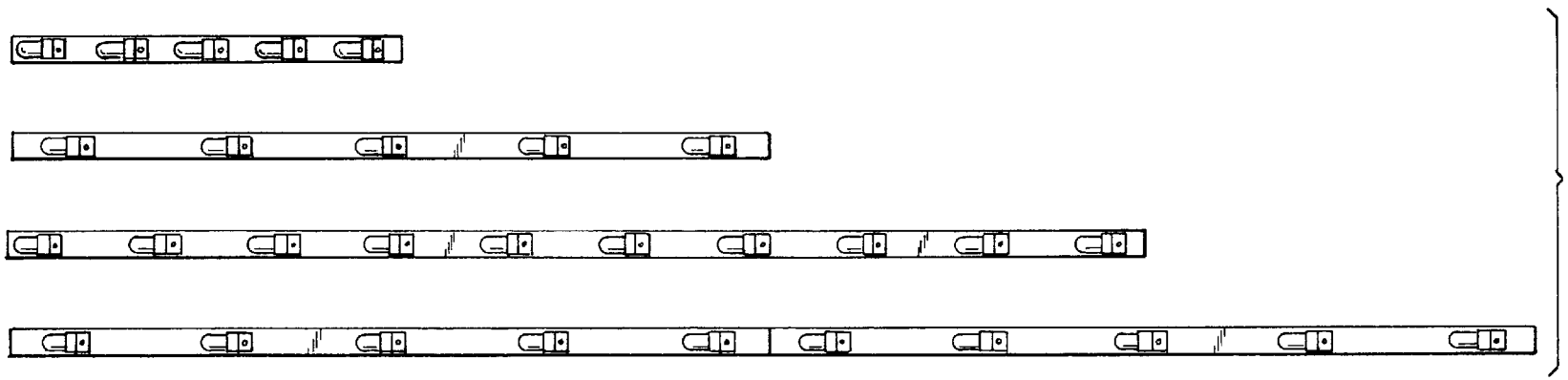
FIG. 11 illustrates various PC board layouts

FIG. 11 illustrates different PC board configurations which are within the scope of the preferred embodiments of the present invention. Different numbers of sockets 10 can be placed on each PC board 6 and the distance between the sockets 10 can vary. Fixtures of various lengths can easily be fabricated. The length of the PC board 6 and molded plastic lens 7 are set modular lengths. The overall length of the fixture 100 can therefore be changed by the addition of more PC board/lens modules. Correspondingly, the extrusion length which is determined by the length of the PC board, will change to accommodate the number of modules required.

While preferred embodiments of the present invention have been described, variations thereto will occur to those skilled in the art and are within the scope of the present inventive concepts which are delineated by the following claims.

What is claimed is:

1. A light fixture consisting of:

a housing having first and second ends;

electrical endcaps located at the first and second ends of the housing; and at least one printed circuit board disposed inside of the housing and electrically connected to at least one of the electrical endcaps;

said printed circuit board consisting of sockets, each said socket containing a lamp contained therein.

2. The light fixture of claim 1, wherein the at least one printed circuit board fits securely into the housing via a channel.

3. The light fixture of claim 1, wherein the housing, electrical endcaps and at least one printed circuit board are arranged to define a modular fixture unit which is adapted to be connected to another of the light fixtures.

4. The light fixture of claim 1, wherein the at least one printed circuit board includes a plurality of sockets each containing a lamp electrically attached thereto.

5. The light fixture of claim 1, further comprising a mounting bracket for mounting the light fixture to a support surface.

6. The light fixture according to claim 5, wherein the at least one printed circuit board rotates via rotating means relative to the support surface.

7. The light fixture according to claim 1, further comprising a high temperature protective lens attached to the housing to cover the at least one printed circuit board and the lamp attached thereto.

8. The light fixture of claim 1, further comprising a plurality of multiple printed circuit boards.

9. The light fixture of claim 3 wherein said another light fixture is connected to said light fixture by a coiled cordset.

10. The lighting fixture of claim 1 wherein said light fixture is connected to a second light fixture via male and female plugs.

* * * * *